US008452040B2

(12) United States Patent
Perovic

(10) Patent No.: US 8,452,040 B2
(45) Date of Patent: May 28, 2013

(54) SPEAKER-TRANSDUCER WITH INTEGRAL BASS-REFLEX AND MAXIMUM EFFICIENCY COOLING

(76) Inventor: Srdjan Perovic, Ottawa (CA)

( * ) Notice: Subject to any disclaimer, the term of this patent is extended or adjusted under 35 U.S.C. 154(b) by 563 days.

(21) Appl. No.: 12/495,787

(22) Filed: Jun. 30, 2009

(65) Prior Publication Data

US 2010/0329497 A1 Dec. 30, 2010

(51) Int. Cl.
*H04R 25/00* (2006.01)

(52) U.S. Cl.
USPC ..... 381/397; 381/398; 381/404

(58) Field of Classification Search
USPC ..... 381/337, 345, 349, 350, 397, 398, 381/403, 404, 405, 412, 420, 432, 433; 181/155, 181/156, 199, 171, 172
See application file for complete search history.

(56) References Cited

U.S. PATENT DOCUMENTS

| | | | | |
|---|---|---|---|---|
| 5,042,072 | A * | 8/1991 | Button | 381/397 |
| 5,909,015 | A * | 6/1999 | Yamamoto et al. | 181/156 |
| 5,940,522 | A * | 8/1999 | Cahill et al. | 381/397 |
| 6,430,300 | B1 * | 8/2002 | Cox et al. | 381/397 |
| 6,504,939 | B1 * | 1/2003 | Fukuda | 381/386 |
| 6,853,734 | B2 * | 2/2005 | Sahyoun | 381/404 |
| 7,570,779 | B2 * | 8/2009 | Sugiura | 381/412 |
| 8,094,866 | B1 * | 1/2012 | Finegan | 381/404 |

* cited by examiner

*Primary Examiner* — Huyen D Le

(57) ABSTRACT

This is a novel speaker design which introduces its own integrated bass-reflex. This design allows for improved cooling for the speaker's voice coil over existing designs and has acoustics that are more natural and of higher quality than known speakers.

3 Claims, 2 Drawing Sheets

SPEAKER-TRANSDUCER WITH INTEGRAL BASS-REFLEX AND MAXIMUM EFFICIENCY COOLING

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

Figure 1:
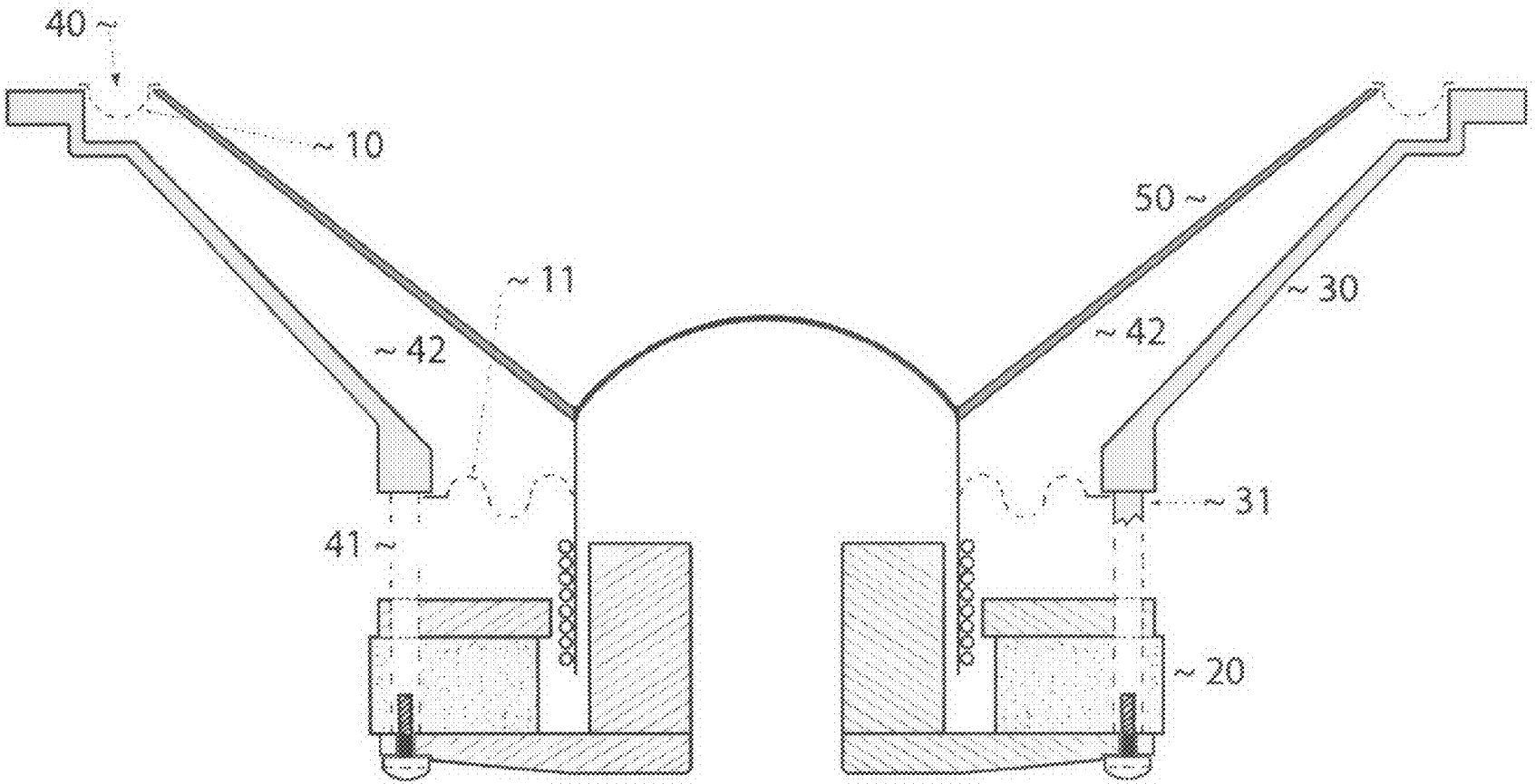

BACKGROUND OF THE INVENTION (1) Field of the Invention

The present invention is related generally to audio speakers.

(2) Description of Related Art

Prior art speaker-transducers comprise a cage-like basket which is connected to the diaphragm by rubber surround foam at one, and spider at the other end. Both, spider and surround foam prevent the air circulation which can cause the coil to overheat.

This prior art speaker construction requires a cabinet with a separate opening—the bass reflex. Bass reflex is located in a different part of the cabinet than the speaker and for that reason, sound is produced from multiple points causing a losses in sound quality.

BRIEF SUMMARY OF INVENTION

According to the invention there is provided an audio speaker suspension connecting the cone diaphragm and the cone basket in such a way that it allows for the cone diaphragm to operate both as a sound radiating surface and as bellows for the internal bass-reflex.

According to a further aspect there is provided an audio speaker with a round-shaped built-in bass-reflex inside a closed cabinet, the speaker comprising:

a cone-shaped diaphragm having a narrower end and a wider end, wherein the diaphragm is attached with the narrower end to a former to which is attached a voice coil that enters into a magnetic assembly and which voice coil produces a vibration of the diaphragm;

a closed cone-shaped basket having a narrower and a wider end surrounding the diaphragm, wherein a space between the diaphragm and the basket increases towards the narrower ends of the diaphragm and basket;

a first set of suspending connectors uniformly distributed around the wider end of the diaphragm for forming a space between the diaphragm and the basket, which serves as an entry area of the bass-reflex, the connectors being adapted to cushion the sound generated by themselves;

a second set of suspending connectors of greater length than the length of the first set of connectors uniformly distributed around the narrower end of the diaphragm for creating a space between the diaphragm and the basket, the connectors being adapted to cushion the sound generated by themselves; and posts physically separating and defining a space between the basket and the magnetic assembly, the size of the space between the basket and the magnetic assembly defines an exit area of the bass-reflex through which an airflow created by the vibrations of the diaphragm passes through to the magnets and into the closed cabinet, and wherein a surface of the exit area of the bass-reflex corresponds in size to a surface of the entry area of the bass-reflex;

wherein the first set of connectors and the second set of connectors connect the diaphragm and basket in such a way that the diaphragm operates as a sound radiating surface and as a first side of the bass-reflex and the basket forms a second side of the bass-reflex; and wherein the airflow between the diaphragm and the basket through the entry area of the bass-reflex, through the exit area of the bass-reflex and to the magnetic assembly cools the voice coil and the magnets.

This is a new type of speaker that for the first time introduces its own, internal bass-reflex. Moreover, this internal bass-reflex doubles as a maximum efficiency cooling mechanism for the speaker's voice coil. This novel design has a cooling effectiveness unsurpassed by anything currently available. This design leads to acoustics that are more natural and of higher quality than achievable with existing speaker designs.

BRIEF DESCRIPTION OF SEVERAL VIEWS OF THE DRAWING(S)

Reference to the figures is exemplary and not intended to be limiting the invention defined in the appended claims.

FIG. 1 is a cutaway of the speaker design from the front-view perspective. The speaker is enclosed completely in a box (not shown in any figure). The speaker elements inside the speaker enclosure (cabinet) are: an embodiment of a magnetic assembly (~20) according to the invention, an embodiment of posts (~31) according to the invention, an embodiment of speaker basket (~30) according to the invention, an embodiment of a cone diaphragm (~50) according to the invention, an embodiment of springs which are covered in a rubber sheath (~10 and ~11) according to the invention, an embodiment of a bass-reflex space (~42) according to the invention, an embodiment of a bass-reflex opening to outside (~40) according to the invention and an embodiment of a bass-reflex opening to the inside of the speaker box enclosure (~41) according to the invention.

Figure 2:
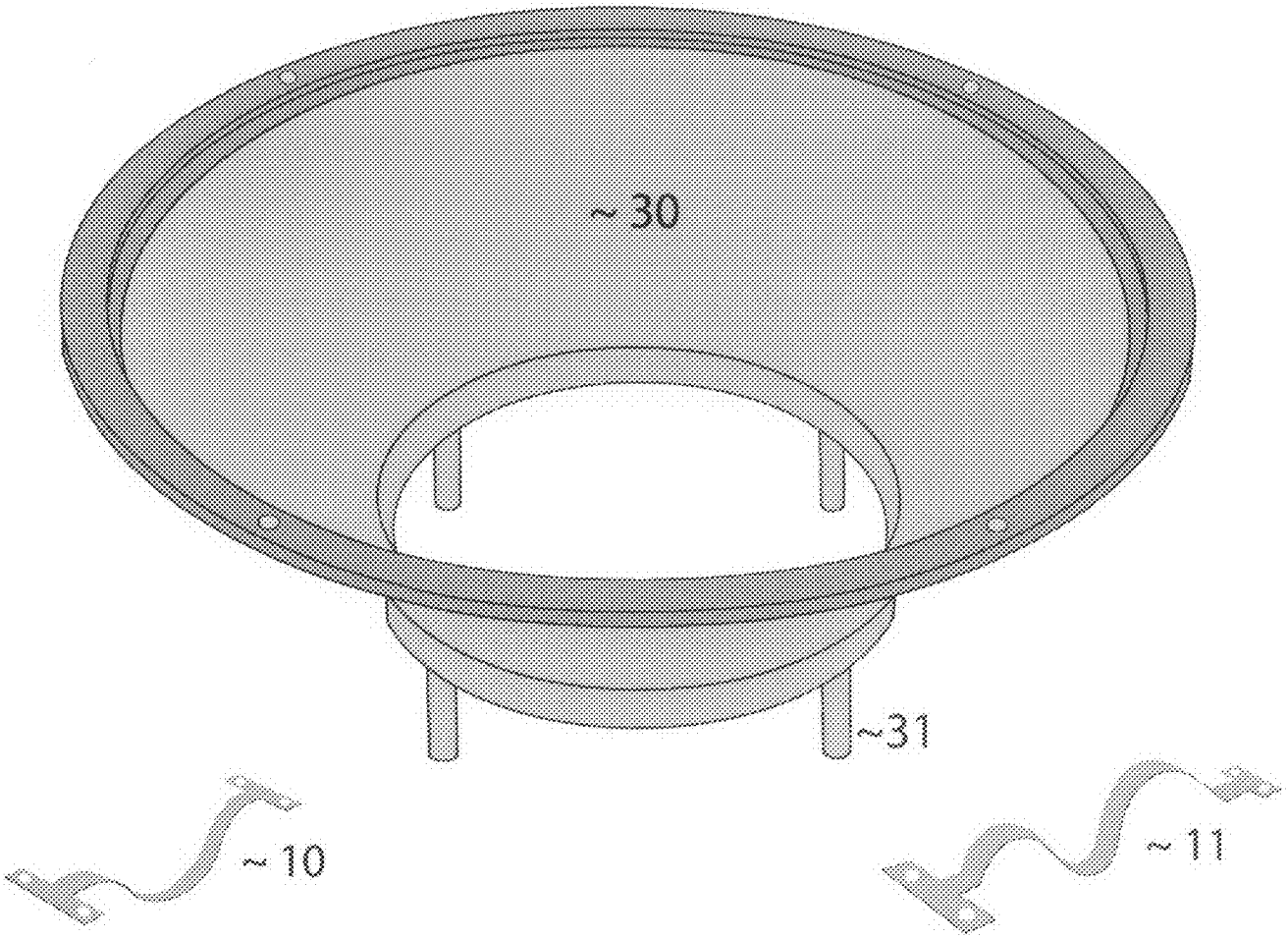

FIG. 2 is an isometric view of an embodiment of a speaker basket (~30) according to the invention, an embodiment of the posts (~31) and an embodiment of springs (~10 and ~11) according to the invention.

DETAILED DESCRIPTION OF THE INVENTION

The basket of the speaker is molded like a cone without any openings (FIG. 2, ~30), which together with the cone diaphragm (FIG. 1, ~50) make the bass-reflex. To clarify, bass-reflex (~42) is the space enclosed between the basket (FIG. 2, ~30) and the diaphragm (FIG. 1, ~50).

The suspension of the cone diaphragm (FIG. 1 ~50) is made of thin, flat metal springs covered in a rubber sheath (FIG. 1, ~10 and FIG. 1, ~11, and FIG. 2 ~10 and ~11) which are attached on one end to the cone diaphragm (FIG. 1 ~50) and on the other to the basket of the speaker (FIG. 1, ~30). The springs are uniformly distributed around the cone diaphragm (FIG. 1 ~50) so that the air circulates freely from the outside, through the gap between the cone diaphragm (FIG. 1 ~50) and the basket (FIG. 1, ~30), and then into the speaker enclosure itself. The number of springs is a function of the size of the speaker, optimally that number is 8.

The posts seen in (FIG. 1, ~31) and (FIG. 2 ~31) physically separate the basket (FIG. 1 ~30) from the magnetic assembly (FIG. 1, ~20) and create and opening, bass-reflex, (FIG. 1 ~41) towards the inside of the speaker enclosure. The opening is also one end of the bass-reflex.

The speaker needs to be in a closed box (cabinet) during the operation of the speaker and the vibration of the cone diaphragm (FIG. 1, ~50). During the vibration of the cone diaphragm (FIG. 1, ~50) the pressure rapidly rises and falls leading to equally rapid flow of air from the opening (FIG. 1 ~40), through the gap between the cone diaphragm (FIG. 1, ~50) and the basket (FIG. 1, ~30), and then between the posts (FIG. 1, ~31) and the openings (FIG. 1, ~41) into the speaker enclosure. The airflow very efficiently cools the speaker's voice coil because of its exposure to the high rate of airflow. A small amount of that airflow passes though the pocket in the magnet and then the hole in the magnet, and, finally, into the speaker box. That additionally cools the voice coil and the magnet.

The springs (FIG. 1, ~10 and FIG. 1, ~11) have a small surface area and, therefore, present very little resistance to the airflow. The rubber sheath serves to cushion the sound generated by the springs themselves, which would otherwise create unwanted, interfering sound.

The size of the entry area of the bass-reflex (FIG. 1, ~40) has to be the same as that of the exit area (FIG. 1, ~41).

Given that currently there are no problems regarding overheating of the voice coil, it is possible to make it smaller and lighter. The result of smaller vibrating mass is an improvement in the performance and the transients of the speaker.

Embodiments of the invention in which an exclusive privilege and property is claimed are:

1. An audio speaker with a round-shaped built-in bass-reflex inside a closed cabinet, the speaker comprising:

a cone-shaped diaphragm having a narrower end and a wider end, wherein the diaphragm is attached with the narrower end to a former to which is attached a voice coil that enters into a magnetic assembly and which voice coil produces a vibration of the diaphragm;

a closed cone-shaped basket having a narrower and a wider end surrounding the diaphragm, wherein a space between the diaphragm and the basket increases towards the narrower ends of the diaphragm and basket;

a first set of suspending connectors uniformly distributed around the wider end of the diaphragm for forming a space between the diaphragm and the basket, which serves as an entry area of the bass-reflex, the connectors being adapted to cushion the sound generated by themselves;

a second set of suspending connectors of greater length than the length of the first set of connectors uniformly distributed around the narrower end of the diaphragm for creating a space between the diaphragm and the basket, the connectors being adapted to cushion the sound generated by themselves; and posts physically separating and defining a space between the basket and the magnetic assembly, the size of the space between the basket and the magnetic assembly defines an exit area of the bass-reflex through which an airflow created by the vibrations of the diaphragm passes through to the magnets and into the closed cabinet, and wherein a surface of the exit area of the bass-reflex corresponds in size to a surface of the entry area of the bass-reflex;

wherein the first set of connectors and the second set of connectors connect the diaphragm and basket in such a way that the diaphragm operates as a sound radiating surface and as a first side of the bass-reflex and the basket forms a second side of the bass-reflex; and wherein the airflow between the diaphragm and the basket through the entry area of the bass-reflex, through the exit area of the bass-reflex and to the magnetic assembly cools the voice coil and the magnets.

2. A speaker according to claim 1, wherein the sets of connectors are adapted to minimize resistance to the airflow.

3. A speaker according to claim 1, wherein the sets of connectors are thin metal springs covered in a rubber sheath.

* * * * *